US011248403B2

(12) United States Patent
Boberschmidt et al.

(10) Patent No.: US 11,248,403 B2
(45) Date of Patent: Feb. 15, 2022

(54) VEHICLE DOOR HANDLE WITH SENSITIVE ACTUATOR

(71) Applicants: U-Shin Italia S.p.A., Pianezza (IT); U-SHIN Deutschland Zugangssysteme GmbH, Erdweg (DE)

(72) Inventors: Werner Boberschmidt, Erdweg (DE); Guillaume Despreaux, Pianezza (IT); Konstantin Pavlov, Erdweg (DE)

(73) Assignees: U-Shin Italia S.p.A., Pianezza (IT); U-SHIN Deutschland Zugangssysteme GmbH, Erdweg (DE)

( * ) Notice: Subject to any disclaimer, the term of this patent is extended or adjusted under 35 U.S.C. 154(b) by 0 days.

(21) Appl. No.: 15/930,880

(22) Filed: May 13, 2020

(65) Prior Publication Data

US 2020/0270916 A1 Aug. 27, 2020

Related U.S. Application Data

(63) Continuation of application No. PCT/EP2018/080125, filed on Nov. 5, 2018.

(30) Foreign Application Priority Data

Nov. 13, 2017 (EP) ..... 17201366

(51) Int. Cl.
*E05B 85/10* (2014.01)
*E05B 81/40* (2014.01)
*E05B 81/06* (2014.01)

(52) U.S. Cl.
CPC ..... *E05B 85/103* (2013.01); *E05B 81/40* (2013.01); *E05B 81/06* (2013.01)

(58) Field of Classification Search
CPC ..... E05B 85/103; E05B 81/40; E05B 81/06; E05B 85/14; E05B 81/34; E05B 81/64
(Continued)

(56) References Cited

U.S. PATENT DOCUMENTS 8,919,047 B2 * 12/2014 Johnsrud ..... E05B 85/107 49/503
10,815,702 B2 * 10/2020 Yoshino ..... E05B 81/76
(Continued)

FOREIGN PATENT DOCUMENTS

EP 3106594 12/2016
WO 2016151116 9/2016

OTHER PUBLICATIONS

International Search Report for International Application PCT/EP2018/080125 dated Feb. 15, 2019.

*Primary Examiner* — Lloyd A Gall
(74) *Attorney, Agent, or Firm* — Burris Law, PLLC

(57) ABSTRACT

A vehicle door handle includes a coupling device having a handle lever movable between a flush position in which the handle lever is flush with an exterior door panel surface, a ready position in which the handle lever is extended and graspable by a user, and an inwards pushed position. The handle lever includes a handle lever shaft rotatively connected to a handle lever base. The vehicle door handle further includes a positioning device, at least one reduction mechanism driven in rotation by an electric motor and driving in rotation the handle lever shaft, and an electronic control unit operable to create a motor short circuit so as to generate a torque resistance on the handle lever.

11 Claims, 4 Drawing Sheets

(58) Field of Classification Search
USPC ..... 70/208; 292/336.3
See application file for complete search history.

(56) References Cited

U.S. PATENT DOCUMENTS

| | | | | |
|---|---|---|---|---|
| 2012/0128344 | A1* | 5/2012 | Kwon | E05B 85/103 396/429 |
| 2013/0076047 | A1 | 3/2013 | Wheeler et al. | |
| 2013/0079984 | A1 | 3/2013 | Aerts et al. | |

* cited by examiner

VEHICLE DOOR HANDLE WITH SENSITIVE ACTUATOR

CROSS-REFERENCE TO RELATED APPLICATIONS

This application is a continuation of International Application No. PCT/EP2018/080125, filed on Nov. 5, 2018, which claims priority to and the benefit of EP 17201366.6, filed on Nov. 13, 2017. The disclosures of the above applications are incorporated herein by reference.

FIELD

The present disclosure relates to a vehicle door assembly, in particular of the type with a flush door handle lever.

BACKGROUND

The statements in this section merely provide background information related to the present disclosure and may not constitute prior art.

Such vehicle door handle assemblies comprise an electric motor which, when actuated, moves the handle lever between a flush position and a ready position. In the flush position, the handle lever is flush with the exterior surface of the door body. In the ready position, the handle lever is protruding from said exterior surface, so as to be graspable by a user.

Once the user grasps the handle lever in its ready position, he can unlatch the door by pulling the lever in a further protruding or extended unlocking position, in which the handle door lever interacts (via a Bowden cable, a rotating pin or a gear mechanism) with a latch mechanism thus unlatching the door.

The electric motor may also move the handle lever from the ready position to the flush position after opening or closing the door. A handle lever spring brings the handle lever back in its ready position when the user releases the handle lever.

Such door handle assemblies also comprise a back-up mechanism, to enable the opening of the door in case of, for example, electric motor or car battery issue i.e. when the electric motor cannot be actuated. This mechanism comprises for example a said push-push mechanism, in which the user pushes the handle lever deep inwards from its flushing position or ready position until reaching a clicking position in which a preloaded spring is released. Said preloaded spring, when released, pushes the handle lever from the inward clicking position in the protruding or extended ready position.

Once the user accesses the vehicle in back-up mode, the battery will generally be recharged, and/or the motor issue will be lifted and normal, electric, actuation can be resumed again.

In normal functioning, the electric motor sets the handle lever in motion via a reduction mechanism, for example a worm drive and gear mechanism, which reduces the rotational speed of the motor actuation while increasing torque value. When the user pushes the handle, associated with a lever from the flushing to the clicking position, said reduction mechanism is actuated in reverse.

U.S. Patent Publication No. 2013/0076047 regarding a door handle assembly that extends in parallel from an outer surface of a vehicle door and retracts the door handle until it is flush with the outer surface is known. This door handle assembly includes a door handle formed from a planar handle member and a handle base member. The planar handle member being coupled to the handle base member and a swing arm coupled to the backside of the handle base member extends and retracts the door handle. A first upper fork is rotatably coupled to a backside of the handle base member near the distal portion of a first post portion and a second upper fork is rotatably coupled to the backside of the handle base member near the distal portion of a second post portion. The lower dual fork portion of the swing arm pivots about a shaft mounted to an inner door surface. However, when a user's hand pushes inward on planar handle member so as to extend vehicle handle, the user does not know how deep he should push i.e. when to stop pushing.

Patent application EP 3106594 A is also known. It relates to a handle for a vehicle door, comprising: an activation member configured to activate a latch of a vehicle door so as to unlatch the door, a grip member configured to cooperate with the activation member so as to unlatch the door, wherein the grip member comprises a gripping part, the grip member being movable between a flushing position in which the gripping part extends flush to an external panel of the door, an active position in which the gripping part projects with respect to the external panel and becomes graspable, and the grip member cooperates with the activation member, and an opening position in which the grip member drives the activation member to activate the latch and unlatch the door, and a driving mechanism and an actuator lever cooperating with the grip member such that the grip member may be driven between the flushing position and the active position, the handle being configured such that when the grip member is pulled according to an opening direction, the grip member drives the activation member which in turn activates the latch to unlatch the door. However, in this disclosure, when a user's hand pushes inward on planar handle member so as to extend vehicle handle, he does not know how deep he should push i.e. when to stop pushing.

SUMMARY

This section provides a general summary of the disclosure and is not a comprehensive disclosure of its full scope or all of its features.

The present disclosure provides a vehicle door handle comprising a coupling device having a handle lever movable between:

a flush position in which said handle lever is flush with an exterior door panel surface, a ready position in which said handle lever is extended and graspable by a user so as to open the door panel, and an inwards pushed position in which said handle lever is retracted at an angle $\alpha$.

The vehicle door handle further comprises:

a handle lever shaft rotatively connected to a handle lever base;

a positioning device adapted to detect the rotation angle $\alpha$ of the handle lever shaft;

at least one reduction mechanism, driven in rotation by an electric motor and driving in rotation the handle lever shaft; and an electronic control unit operable to receive inputs from the positioning device and to send a signal to the motor, wherein the electronic control unit is operable to create a motor short circuit so as to generate a torque resistance on the handle lever once an inwards pushed predetermined angle of rotation a of the handle lever is reached.

In one form, the predetermined angle of rotation a is with a range:

$$-2.3° \leq \alpha \leq -0.4° \quad \text{Math. 1}$$

Thus allowing an early detection of movement and triggering of motorized door handle extension.

In a further refinement, the predetermined angle of rotation a is within a range:

$$-2° \leq \alpha \leq -0.5° \quad \text{Math. 2}$$

Thus allowing a more precise and reproducible detection of movement and triggering of motorized door handle extension.

In one form, the reduction mechanism comprises a first worm drive with a first worm screw and a first corresponding worm gear. This produces less noise for the reduction mechanism due to the helical teeth involved in the worm screw and the worm gear.

In another form, the reduction mechanism further comprises a second worm drive with a second worm screw, a second corresponding gear wheel, and a transmission shaft which is adapted to transmit the rotational motion of the first worm gear to the second worm screw so as to increase the resistant torque informing the user that he has reached the desired angle.

According to another form of the present disclosure, the motor has a motor shaft which axis of rotation is perpendicular to the axis of rotation of the transmission shaft, so as to reduce the handle frame volume and save space in the door frame thickness.

According to a further form of the present disclosure, the motor has a motor shaft which axis of rotation is parallel to the axis of rotation of the handle lever shaft so as to reduce the handle frame volume and save space in the door frame thickness.

According to a further refinement of the present disclosure the positioning device is a magnetic sensor located at the opposite side of the lever base on the handle lever shaft so as to improve rotation angle accuracy.

The vehicle door handle according to the present disclosure may further include a push-push lever cylinder, rotatively coupled with the handle lever shaft, interacting via a push-push lever with a push-push unit when the handle lever is pushed inwards in a clicking position so as to release a preloaded push-push unit and push the handle lever in the ready position in a non-motorized fashion. This allows having a back-up totally mechanical mechanism in case of electrical energy issue rendering the motor inoperable.

It can further be provided that the clicking position so as to release a preloaded push-push unit and push the handle lever in the ready position in a non-motorized fashion is reached at a rotation angle $\alpha$ higher than $-2.3°$. Thus avoiding involuntary triggering of the back-up mechanism when there is no energy furniture issue.

It can further be provided that the electronic control unit is operable to further instruct the motor to extend or retract the door handle lever at a predetermined time (t) after generation of torque resistance on the handle lever thus making the mechanism according to the present disclosure usable in different starting position. A retraction instruction can be given after an inwards push from ready position for instance.

The present disclosure informs the user when to stop pushing the door handle so as to extend the door handle in a motorized and aesthetic fashion.

In the door handle according to the present disclosure a counter-force is applied by the door handle transmitted by the door handle lever base. Such counter-force informs the user that he has pushed the door handle deep enough to trigger the motorized door handle extension.

The user thus receives a message when the vehicle control unit and/or door control unit has detected the signal from the positioning device that a predefined angle $\alpha$ has been reached. In one form, the positioning device is a sensor located on the handle lever shaft so as to improve angle precision.

The positioning device output, for example the sensor output, is received by the control unit of the handle and/or of the vehicle. A command of shortcut of the motor is sent by the control unit thus connecting the positive and negative terminals of the motor. The result is an increase of viscosity with an extra load during the movement driven by the handle lever being pushed inwards. The inversion creates a higher resistant torque on the motor axis, such torque is transmitted to the lever base by the worm drive mechanism or gear box of the door handle according to the present disclosure and felt by the user who realizes he has reached the unlocking point. The additional torque obtained by the motor shortcut is amplified by more than 60 times when using the double stage reduction mechanism according to the present disclosure.

Advantageous Effects of the Present Disclosure

The user feels the extra load and stops the pushing movement at the right time instead of further pushing and potentially activating the back-up push-push mechanical system.

The user feels the extra load and stops the pushing movement at the right time instead of further pushing and potentially activating the back-up push-push mechanical system.

An advantage of the present disclosure is that in case of low battery for the door handle, this motor short cut extra load will not be activated and will not disturb the safety (back-up) mechanism of extension of the door handle according to the present disclosure.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
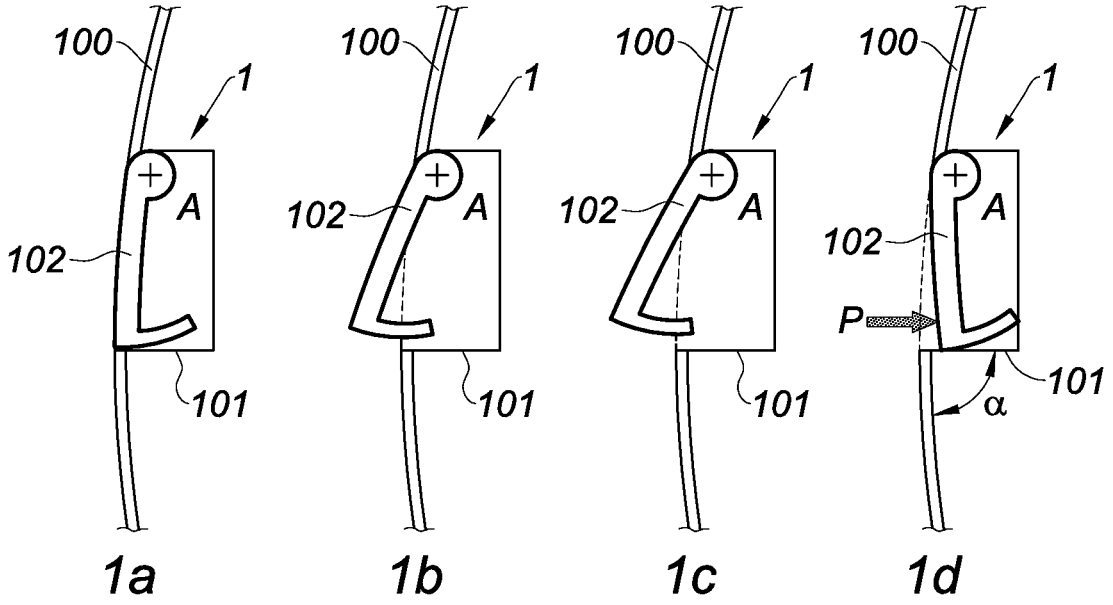
FIG. 1 is a schematic cut away of a vehicle door with a handle comprising a handle lever represented in different positions, 1*a* through 1*d*, according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows a series of schematic cutaways of a vehicle door panel 100 having a built-in door handle 1. The door panel 100 forms an exterior surface of the vehicle, the door handle 1 is essentially represented by its handle lever 102 i.e. the part meant to be grasped and set in motion by a user and a handle frame 101 i.e. the part that remains stationary during actuation.

In the first cutaway 1*a* of FIG. 1, the handle lever 102 is in a flush position. In said flush position, the outer surface of the handle lever 102 is flush with the door panel 100. Said flush position is adopted when the vehicle is driving or when it is parked for long times. In the flush position, the handle lever 102 is less likely, when parked, to be interacted by passers-by, accidentally or not, and air drag is reduced when driving. In the flush position, the handle lever 102 also appears integrated in the door panel 100 in a pleasant and discrete way.

In the second cutaway 1*b* of FIG. 1, the handle lever 102 is in a ready position. In said ready position, the handle lever 102 has rotated outwards by a predefined angle of 20 to 45° for example around a handle axis A, so as to be graspable by the user. It is mentioned that the angle $\alpha$ is equal to 0° when the door handle lever 102 is flush with the door panel and the trigonometric reference is used to define positive and negative angles in FIG. 1. Said ready position is adopted when the user approaches the vehicle or causes unlocking of the doors, for example using a remote control integrated in a key or a RFID security token or just by pushing a button located on the door frame or close to such door frame. In said position the handle lever 102 is available and graspable for the user.

In the third cutaway 1*c* of FIG. 1, the handle lever 102 is in an open position. Compared to the ready position, the handle lever 102 has been rotated further outwards at an angle, for example, between 40° to 60° and more by the user, and the handle lever interacts with a latch mechanism to unlatch the door, which is consequently unlatched and ready to be opened by pulling further on the handle lever 102.

In FIG. 1*d* of FIG. 1, the handle lever 102 is in an inwards pushed position which represents the situation when the handle lever 102 is pushed inwards at an angle $\alpha$ detected by a sensor so as to launch the actuator and extend the vehicle door handle 1. In FIG. 1*d*, the door handle 1 is pushed inwards at an angle $\alpha$ between −0.4° and −2.3° using the trigonometric reference in FIG. 1*d*. Such angle is detected by a sensor placed on the door handle lever frame 101; the electronic control unit 9 then launches the motor driven actuator and extends the vehicle door handle 1.

In the event of a mechanical or electrical issue with the mechanism that drives the handle lever 102 from the flush position to the ready position, the user can push the handle lever 102 deeply inwards with respect to the door panel 100 at an angle $\alpha$ between −2.4° and −5° by applying inwards directed pressure P on the handle lever 102. In this case, the handle reaches a position called clicking position, where a mechanical interaction here called a "click" releases a spring 42 of a push-push unit 4 that drives the handle lever 102 in ready position without actuation of a motor via a push-push lever 31 connected in rotationally fixed manner to the handle lever shaft 22.

There are therefore two steps to launch door handle extension to ready position: a first one pushing at an angle $\alpha$ between −0.4° and −2.3° triggering door handle extension with the motorized actuator and a second back-up step used in case of electrical issue of the mechanism involving a push at an angle $\alpha$ between −2.4° and −5° triggering door handle extension with the back-up push-push non-motorized mechanism.

Figure 2:
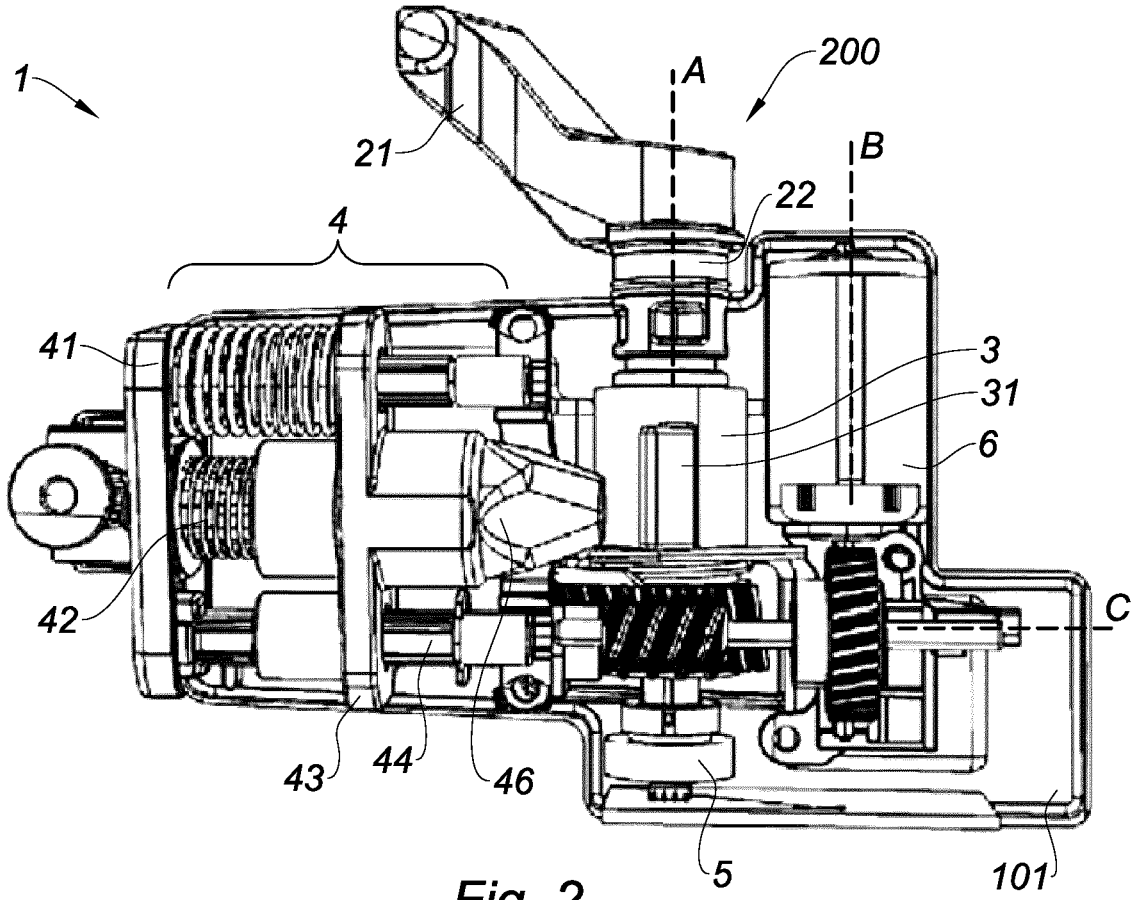
FIG. 2 is a schematic side view of a vehicle door handle according to the present disclosure.

In FIG. 2, the handle lever 102 is rotatively mobile with respect to the handle frame 101, which is to be attached to an interior surface of the vehicle door panel 100. The frame 101 comprises housings for most parts of the door handle 1.

Figure 3:
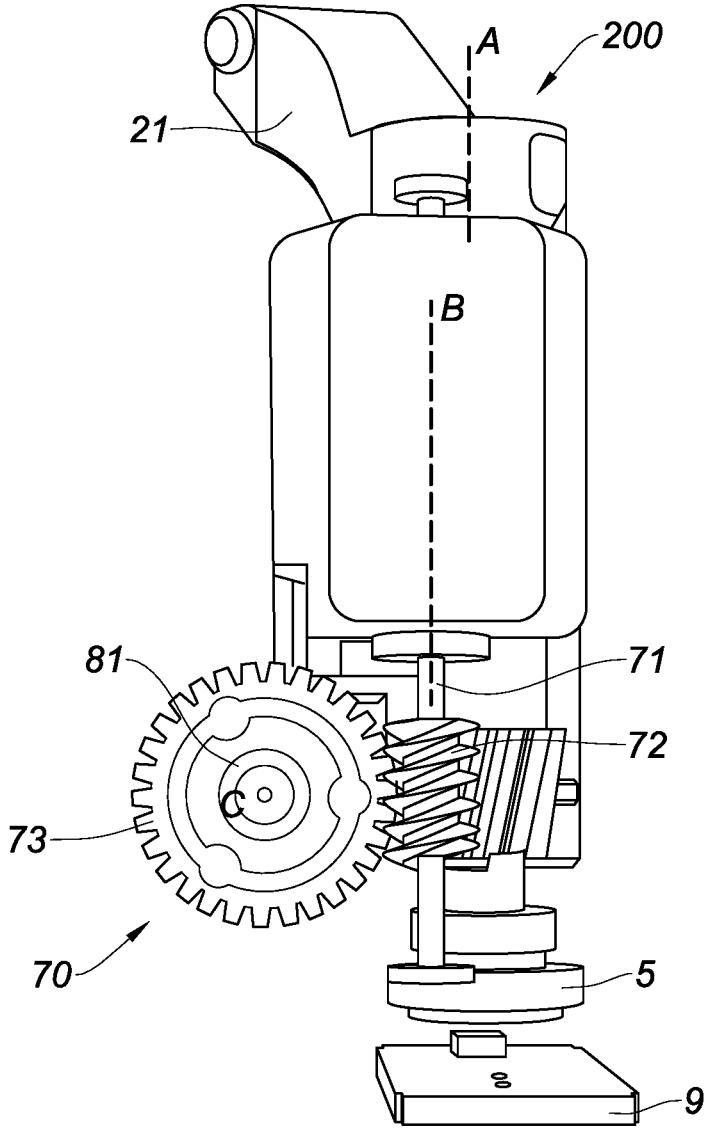
FIG. 3 is side view of the door handle actuator showing the first transmission stage according to the present disclosure.

In a housing of the frame 101 is an electric motor 6 with a reduction mechanism 70, 80 represented in FIG. 3. The electric motor 6 is activated by injection of electric current, in particular from a vehicle battery. The reduction mechanism 70, 80, which in one form is a coupling gear, adapts the rotary output motion of the electric motor 6 by reducing rotational speed and increasing the torque values. The reduction mechanism 70, 80 sets the handle lever 102 in motion, in particular from the flush position to the ready position or from the ready position back to the flush position.

Figure 4:
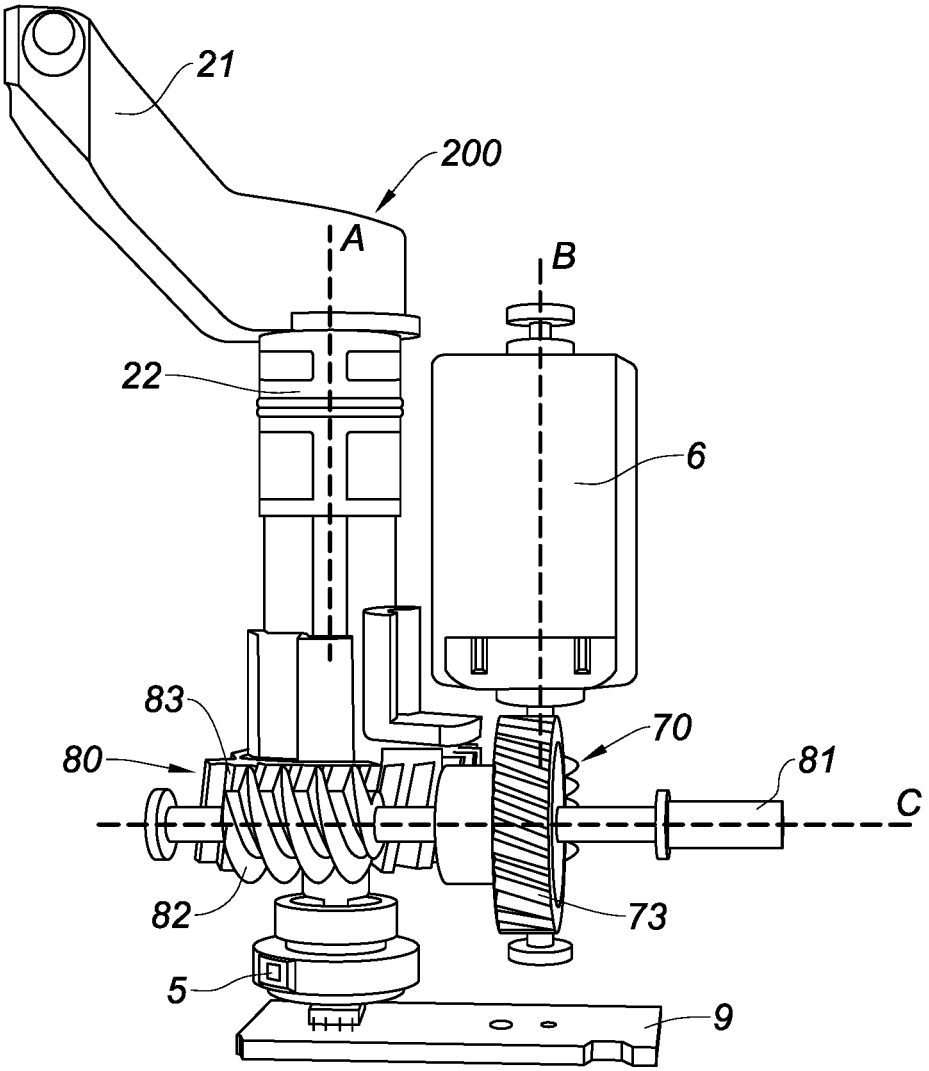
FIG. 4 is a front view of the door handle actuator showing the second transmission stage according to a plane perpendicular to axis A according to the present disclosure.

The reduction mechanism 70, 80 comprises for example one or more reduction stages, with reduction wheel gears and/or worm and gear systems. In this form, FIGS. 3 and 4 show the transmission or coupling device 200 stages 1 and 2. Stage 1 being referenced 70 and stage 2 being referenced 80.

In FIGS. 3 and 4, the coupling device 200 comprises the handle lever shaft 22, which extends axially from the lever base 21, and the reduction mechanism 70, 80.

The reduction mechanism 70, 80 comprises a first reduction stage 70 and a second reduction stage 80, having each a worm drive i.e. a gear arrangement in which a worm screw meshes with a worm gear that is here a gear wheel with helical teeth matching the worm screw. Therefore, the first worm drive 70 of the first reduction stage 70 comprises a first worm screw 72 visible at FIG. 4 and a first worm gear 73, and the second worm drive 80 of the second reduction stage 80 comprises a second worm screw 82 and a second worm gear 83.

The first worm screw 72 of the first reduction stage 70 visible at FIG. 4 is set in motion by the torque applied by the electric motor 6. Said first worm of said first reduction stage 70 sets in turn the first worm gear 73 in rotational motion around a second axis C, orthogonal to the first axis A. The rotational motion of the first worm gear 73 is transmitted by a transmission shaft 81 (cf. FIG. 3) to the second worm screw 82 of the second reduction stage 80. The axis of rotation A of the handle lever shaft and the axis of rotation B of the Motor shaft 71 are parallel and both axis A, B are perpendicular to the axis C of the transmission shaft 81 so as to reduce the volume of the door handle assembly.

The second worm screw 82 of the second reduction stage 80 sets the second worm gear 83 in motion. The second worm gear 83 is rotationally coupled to the handle lever shaft 22. In particular, in this form, the second worm gear 83 forms the portion of the lever shaft opposite the lever base 21.

The second worm gear 83 comprises a tubular body, forming the lower axial portion of the handle lever shaft 22 in FIG. 3, its lower extremity carrying helical teeth which mesh with the second worm gear 83 to form the worm drive. The push-push lever 31 is radially protruding from the tubular body of the second worm gear 83.

The two stage reduction mechanism 70, 80 sets the coupling device 200 in motion. The coupling device 200 comprises a lever base 21, to which a handle lever body is coupled to so as to obtain the assembled handle lever 102.

The frame 101 also houses a push-push unit 4, comprising two push-push springs 41, placed around two guiding rods 44. The push-push springs 41 push, when released, a slider 43 carrying a push-push finger 46 which is able to push against a push-push lever 31 (see FIG. 2) of the coupling device 200. The push-push finger 46 is in particular made of rubber, soft plastic or any shock absorbing material.

The springs 41 and guiding rods 44 are placed on each side of a release mechanism 42, which, when being compressed up to a clicking position, releases the slider 43 which is then pushed by the springs 41 along the guiding rods 44, pushing against the push push lever 31 and therefore driving the handle lever 102 in rotation up to the ready position.

The rotational position of the handle lever 102 is detected by positioning device 5, that can be on the lower side of the coupling device 200. Said positioning device 5 comprises a magnetic index and a magnetic sensor (e.g. a Hall effect sensor). The magnetic index rotates with the handle lever 102, the magnetic sensor then determinates the exact rotational position of the magnetic index, and thus the exact position of the handle lever 102.

It is to be noted that the sensor can be mechanical, electromechanical, magnetic, piezo-electric as long as it is capable of detecting a force, a change in force, a distance or a stroke, an electrical resistance or a change of electrical resistance, or even a deformation. The important point is that the information received by the electronic control unit 9 can be detected and processed to be turned into a signal.

In one form, the positioning device 5 is a magnetic sensor unit that is directly positioned on the handle lever. The effect of such positioning is that the magnetic sensor is directly sensing the position of the handle since it is de-correlated from the actuator positioning. Sensing will be better due to reduced kinematic chain i.e. less cumulated clearance.

The second worm gear 83 and push-push lever cylinder 3 correspond to two axial portions of the handle lever shaft 22, and they surround said handle lever shaft 22 while being axially spaced.

Said handle lever shaft 22 is bound in rotation with the handle lever base 21, second worm wheel 83 and the push-push lever cylinder 3, in particular, they may be solidly linked.

Figure 5:
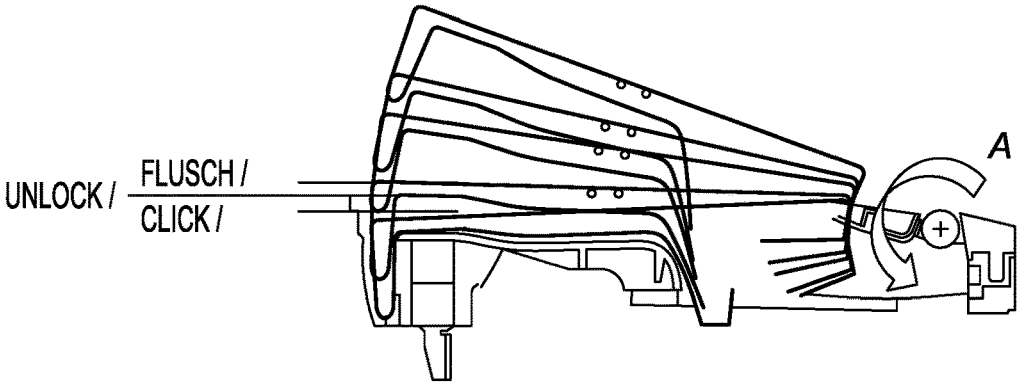
FIG. 5 is an illustration of the push mechanism to launch the unlock mechanical response according to the present disclosure.
Figure 6:
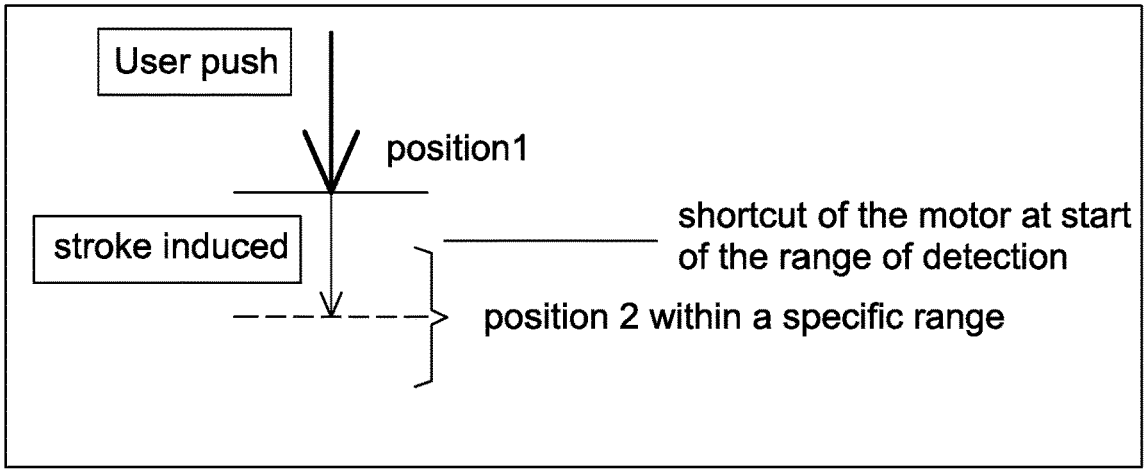
FIG. 6 is a schematic explanation of the push mechanism to launch the unlock mechanical response according to the present disclosure.
Figure 7:
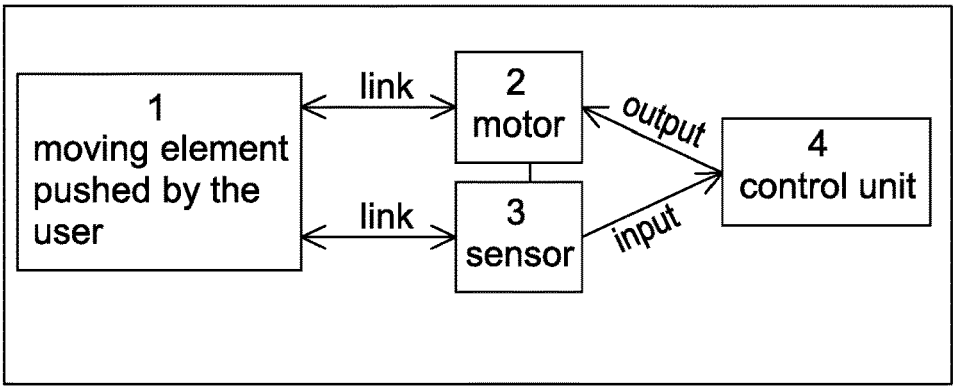
FIG. 7 illustrates the links between the elements according to the present disclosure.

The second worm gear 83 comprises a tubular body, covered partially on its axial side by helical meshing teeth to cooperate directly or indirectly with the electric motor 6, for example via a worm and gear link as a first optional stage. In FIG. 5 showing the door handle 1 according to the present disclosure, the different positions of the handle lever 102 are represented when being pushed. In the flush position, the angle $\alpha$ is considered to be null.

In the door handle 1 according to the present disclosure a counter-force is applied by the door handle 1 transmitted by the lever base 21. Such counter force informs the user that he has pushed the door handle 1 deep enough to trigger the motorized door handle extension.

The user thus receives a message when the control unit 9, e.g. the vehicle control unit 9 and/or door control unit 9, has detected the signal from the positioning device 5 that an angle $\alpha$ between $-0.4°$ and $-2.3°$ has been reached. In one form, the positioning device 5 is a sensor located on the handle lever shaft 22 so as to improve angle precision.

The positioning device 5 output, for example the sensor 5 output, is received by the control unit 9 of the door handle 1 and/or of the vehicle. A command of shortcut of the electric motor 6 is sent by the control unit 9 i.e. connecting the positive and negative terminals of the electric motor 6. The result is an increase of viscosity with an extra load during the movement driven by the handle lever being pushed inwards. The inversion creates a higher resistant torque on the electric motor axis, such torque is transmitted to the lever base by the worm drive mechanism or gear box of the door handle 1 according to the present disclosure and felt by the user who realizes he has reached the unlocking point. The additional torque obtained by the electric motor 6 shortcut is amplified by more than 60 times when using the double stage reduction mechanism 70, 80 according to the present disclosure.

INDUSTRIAL APPLICABILITY

The coupling device for door handle 1 according to the present disclosure can be used with any system for any application that uses positioning device, a motor and an action from user within a specific range of stroke so as to launch an action.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A vehicle door handle comprising:

a coupling device having a handle lever movable between:

a flush position in which the handle lever is flush with an exterior door panel surface, a ready position in which the handle lever is extended and graspable by a user so as to open the exterior door panel surface, and an inwards pushed position in which the handle lever is retracted at a rotation angle, the handle lever comprising a handle lever shaft rotatively connected to a handle lever base about the rotation angle;

a positioning device adapted to detect the rotation angle of the handle lever shaft;

at least one reduction mechanism, driven in rotation by an electric motor and driving in rotation the handle lever shaft; and a control unit operable to receive inputs from the positioning device and to send a signal to the electric motor, wherein the control unit is operable to launch an actuator driven by the electric motor so as to generate a torque resistance on the handle lever once an inwards pushed predetermined angle of rotation a of the handle lever shaft is reached.

2. The vehicle door handle according to claim 1, wherein the inwards pushed predetermined angle of rotation a is within a range:

$$-2.3° \leq \alpha \leq -0.4°.$$

3. The vehicle door handle according to claim 1, wherein the inwards pushed predetermined angle of rotation a is within a range:

$$-2° \leq \alpha \leq -0.5°.$$

4. The vehicle door handle according to claim 1, wherein the at least one reduction mechanism comprises a first worm drive with a first worm screw and a first worm gear.

5. The vehicle door handle according to claim 4, wherein the at least one reduction mechanism further comprises a second worm drive with a second worm screw, a second worm gear, and a transmission shaft which is adapted to transmit a rotational motion of the first worm gear to the second worm screw.

6. The vehicle door handle according to claim 5, wherein the electric motor has a motor shaft comprising an axis of rotation perpendicular to an axis of rotation of the transmission shaft.

7. The vehicle door handle according to claim 5, wherein the electric motor has a motor shaft comprising an axis of rotation parallel to an axis of rotation of the handle lever shaft.

8. The vehicle door handle according to claim 1, wherein the positioning device is a magnetic sensor located opposite to the handle lever base and on the handle lever shaft.

9. The vehicle door handle according claim 1 further comprising a push-push lever cylinder rotatively coupled with the handle lever shaft, wherein the push-push lever cylinder interacts via a push-push lever with a push-push unit when the handle lever is pushed inwards in a clicking position so as to release the push-push unit and push the handle lever in the ready position in a non-motorized fashion.

10. The vehicle door handle according to claim 9, wherein the clicking position so as to release the push-push unit and push the handle lever in the ready position in a non-motorized fashion is reached at a rotation angle higher than −2.3°.

11. The vehicle door handle according to claim 1, wherein the control unit is operable to instruct the electric motor to extend or retract the handle lever at a predetermined time after generation of the torque resistance on the handle lever.

* * * * *